US007207817B1

(12) United States Patent
Cheng

(10) Patent No.: US 7,207,817 B1
(45) Date of Patent: Apr. 24, 2007

(54) ARCING PREVENTION INSERT FOR A COMMUNICATION SOCKET

(75) Inventor: Chia-Chi Cheng, Taipei Hsien (TW)

(73) Assignee: Suyin Corporation (TW)

( * ) Notice: Subject to any disclaimer, the term of this patent is extended or adjusted under 35 U.S.C. 154(b) by 0 days.

(21) Appl. No.: 11/401,999

(22) Filed: Apr. 12, 2006

(51) Int. Cl.
*H01R 13/53* (2006.01)

(52) U.S. Cl. ..... 439/181; 439/939; 439/607

(58) Field of Classification Search ..... 439/181, 439/186, 187, 607, 608, 924.1, 934, 939
See application file for complete search history.

(56) References Cited

U.S. PATENT DOCUMENTS 5,080,604 A * 1/1992 Rider et al. ..... 439/357
5,083,945 A * 1/1992 Miskin et al. ..... 439/607
5,213,518 A * 5/1993 Weidler ..... 439/211
6,210,237 B1 * 4/2001 Chang ..... 439/676
6,659,806 B2 * 12/2003 Shi et al. ..... 439/676

* cited by examiner

*Primary Examiner*—James R. Harvey
(74) *Attorney, Agent, or Firm*—Hershkovitz & Associates; Abe Hershkovitz

(57) ABSTRACT

A communication socket includes a hollow casing, a connection socket and an enclosure. The casing is provided with a rear wall extending from a rear side thereof and two cutouts defined in a front side thereof. The connection socket is received in the hollow casing and has two fingers formed on a front portion thereof to correspond to and to be received in the two cutouts of the casing, terminals extending from a rear side thereof and two seats formed on opposite sides of the rear side of the connection socket. The enclosure is provided to enclose the rear wall and configured to be supported by the two seats of the connection socket so that arcing between the terminals and the rear wall is prevented.

2 Claims, 4 Drawing Sheets

ARCING PREVENTION INSERT FOR A COMMUNICATION SOCKET

BACKGROUND OF THE INVENTION

1. Field of the Invention

The present invention relates to an arcing prevention insert, and more particularly to an arcing prevention insert used in an electromagnetic influence free communication socket to avoid arc resulted from high voltage in the communication socket to influence the operation of the communication socket.

2. Description of the Prior Art

The currently available electromagnetic influence (EMI) free communication socket is shown in FIG. 4 and has a casing (50) made of metal and a connection socket (60) enclosed by the casing (50). The casing (50) has two cutouts (51) defined in a top face thereof and a rear wall (52) formed on a rear side thereof. The connection socket (60) has two fingers (61) extending from a top portion thereof to correspond to and to be received in the two cutouts (51) of the casing (50), terminals (62) extending from a rear side of the communication socket (60) and a baffle (63) formed above the terminals (62).

It is noted that after the combination between the casing (50) and the connection socket (60), the baffle (63) is located between the terminals (62) and the rear wall (52) so that the baffle (63) is able to stop arcing between the terminals (62) and the rear wall (52) to influence the operation of the EMI free communication socket (60). However, due to the design flaws, arc still occurs between the rear wall (52) and the terminals (62) due to high voltage during the operation of the communication socket (60).

To overcome the shortcomings, the present invention tends to provide an improved arcing prevention insert to mitigate the aforementioned problems.

SUMMARY OF THE INVENTION

The primary objective of the present invention is to provide an improved arcing prevention insert used in an EMI free communication socket to avoid arcing between terminals and the casing of the communication socket.

In order to accomplish the aforementioned objective, the arcing prevention insert is an enclosure having a slot configured to securely receive therein the rear wall of the communication socket so that arcing is stopped by the enclosure.

Other objects, advantages and novel features of the invention will become more apparent from the following detailed description when taken in conjunction with the accompanying drawings.

DETAILED DESCRIPTION OF THE PREFERRED EMBODIMENT

Figure 1:
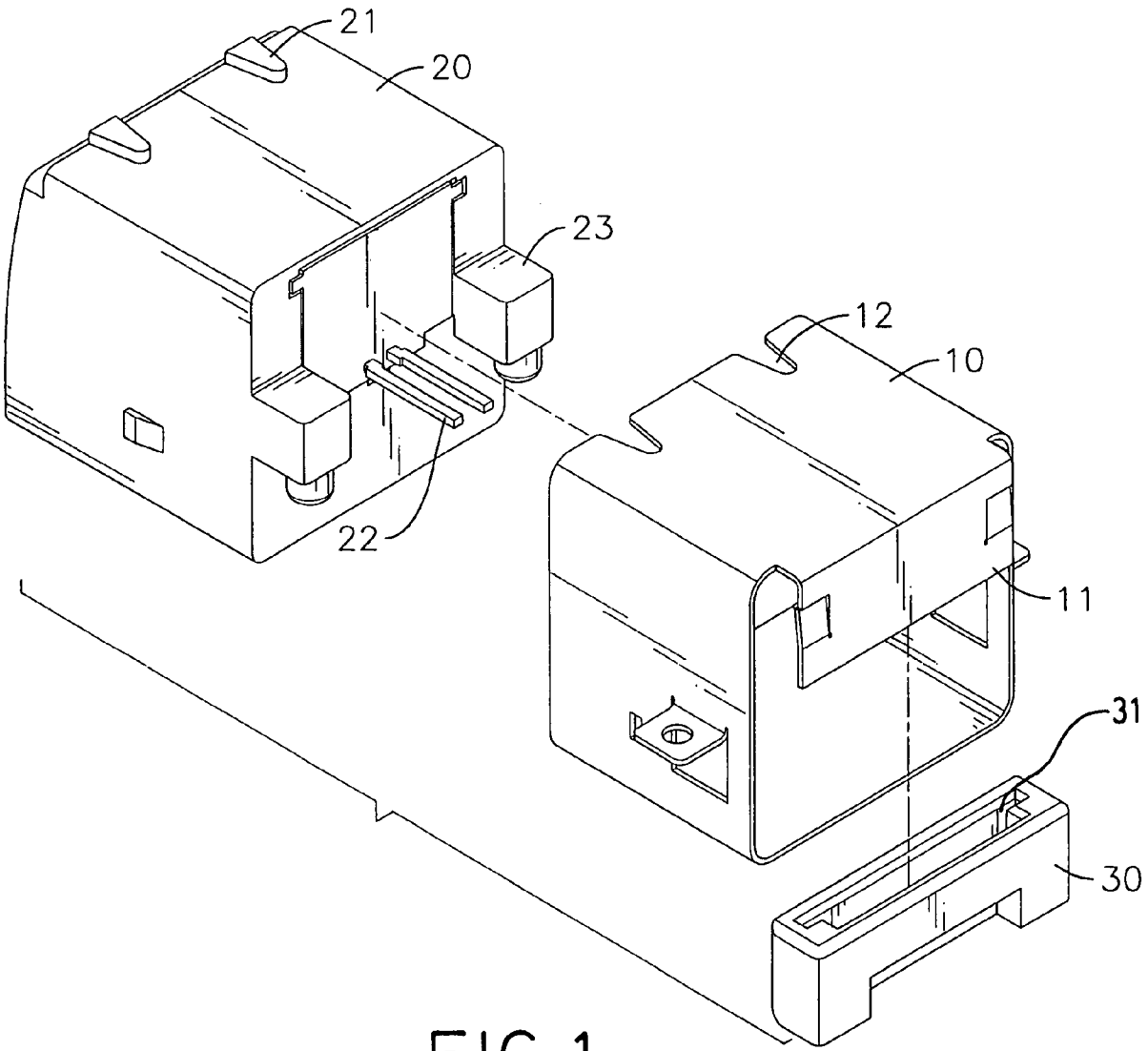
FIG. 1 is a exploded perspective view of the communication socket of the present invention.

With reference to FIG. 1, it is noted that the communication socket in accordance with the present invention includes a hollow casing (10) with two openings in communication with one another, a connection socket (20) and an insert (30).

The casing (10) is made of metal and has a rear wall (11) extending from a rear side of the casing (10) and two cutouts (12) defined in a top face of the casing (10).

The connection socket (20) is to be inserted and received in the casing (10). The connection socket (20) includes two fingers (21) formed on a front side thereof to correspond to the two cutouts (12) of the casing (10), terminals (22) extending from a rear side of the connection socket (20) to extend through the casing (10) and two seats (23) formed on opposite sides of the rear side of the connection socket (20).

The enclosure (30) is made of plastic and has a slot (31) defined in a side thereof to correspond to the rear wall (11) of the casing (10).

Figure 2:
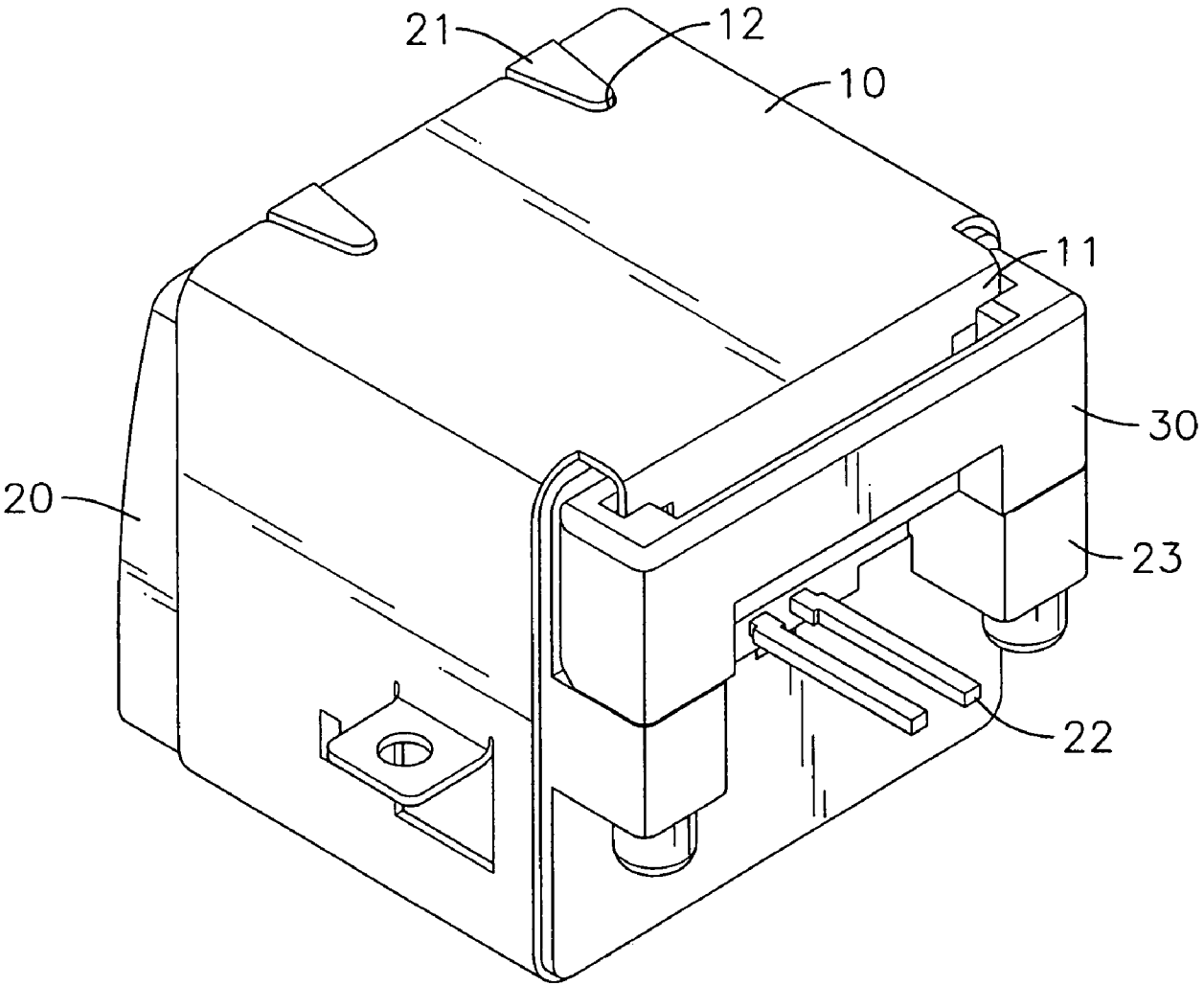
FIG. 2 is a perspective view of the communication socket in assembly.
Figure 3:
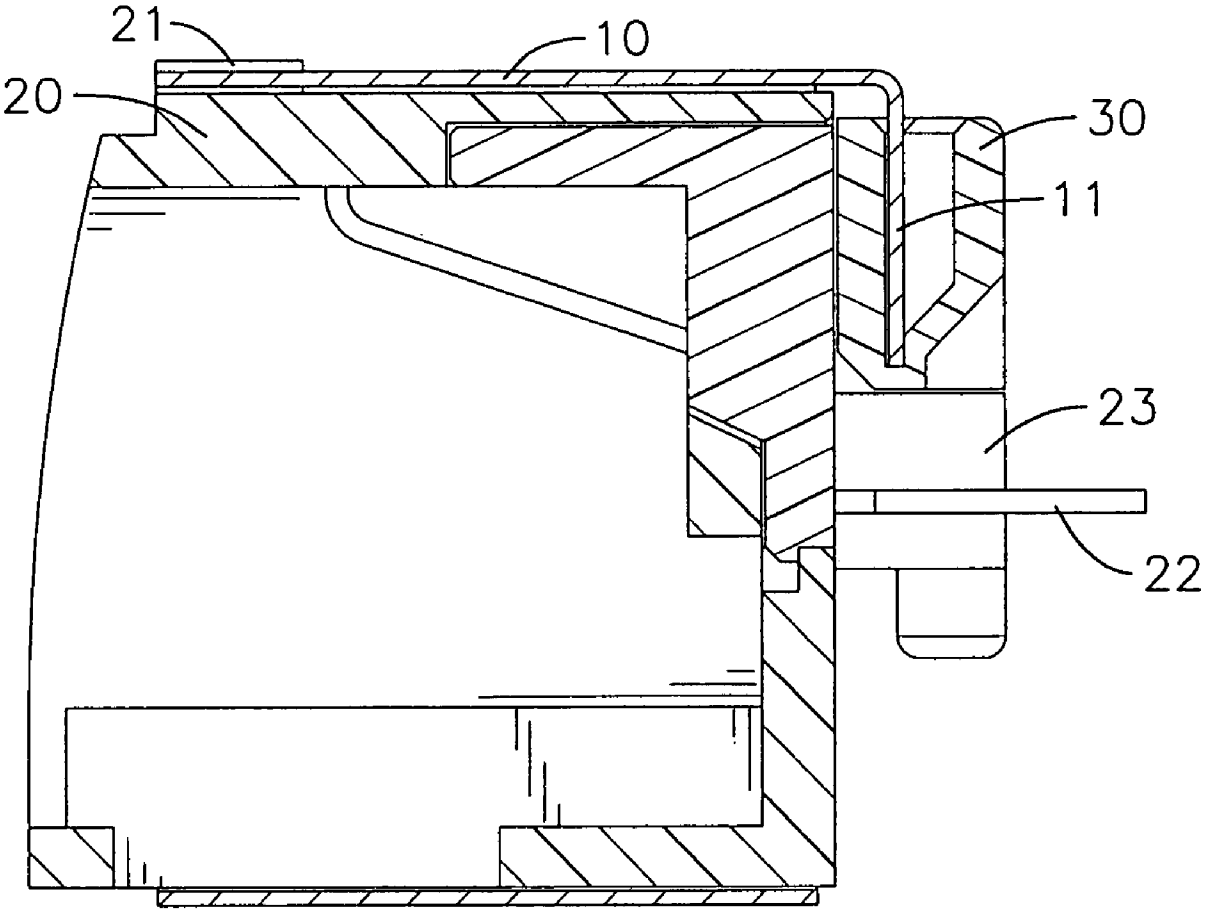
FIG. 3 is a partially cross sectioned view of the communication view in FIG. 2.
Figure 4:
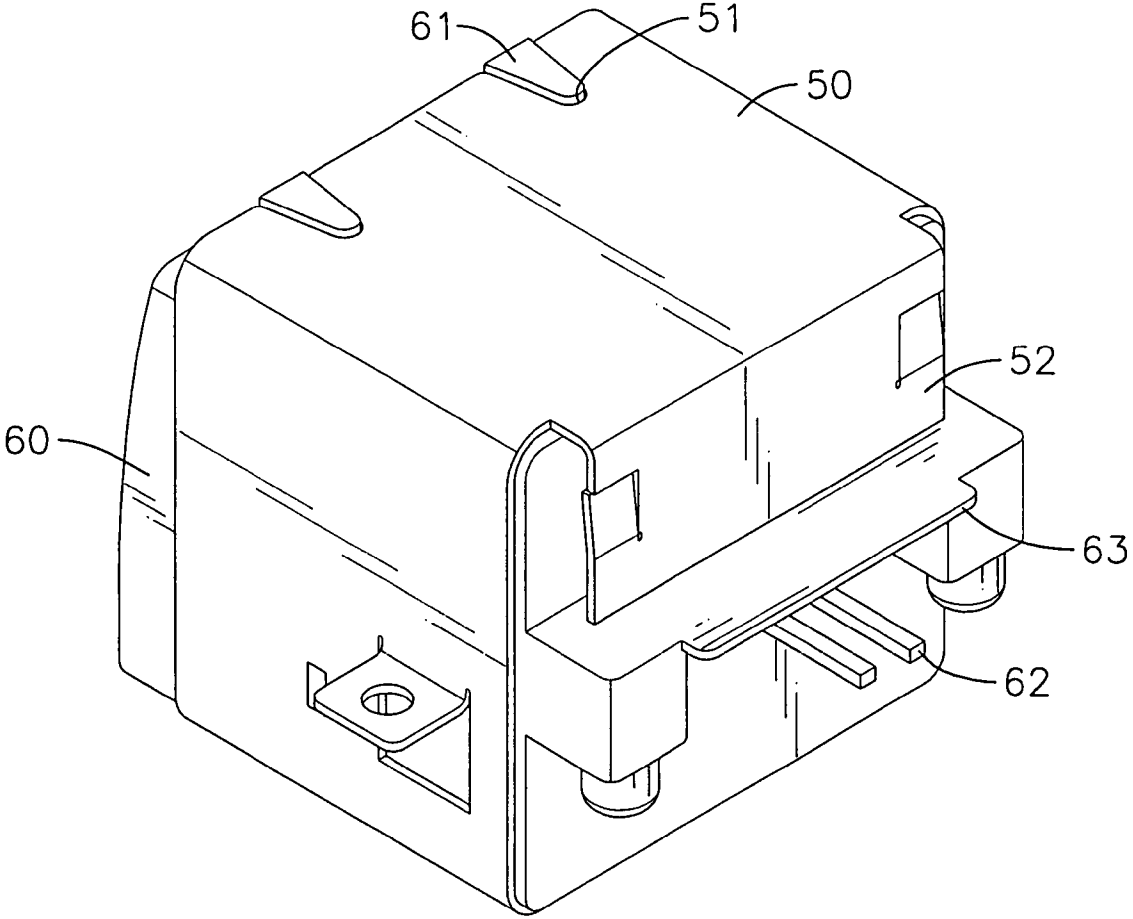
FIG. 4 PRIOR ART
FIG. 4 is a perspective view of the conventional communication socket.

With reference to FIGS. 2 and 3, it is noted that when the communication socket of the present invention is assembled, the rear wall (11) is received in the slot (31) of the enclosure (30) which in turn is supported by the two seats (23) after the connection socket (20) is inserted into the casing (10).

From the description above, it is noted that the enclosure (30) covers the rear wall (11) of the casing (10) to isolate the rear wall (11) from the terminals (22) such that when the communication socket of the present invention is in use and high voltage exists in the terminals (22), the enclosure (30) minimizes the possibility of having arcing between the rear wall (11) and the terminals (22).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a communication socket having a hollow casing provided with a rear wall extending from a rear side thereof and two cutouts defined in a front side thereof, a connection socket received in the hollow casing and having two fingers formed on a front portion thereof to correspond to and to be received in the two cutouts of the casing, terminals extending from a rear side thereof and two seats formed on opposite sides of the rear side of the connection socket, wherein the improvements comprise:

an enclosure is provided to enclose the rear wall and configured to be supported by the two seats of the connection socket so that arcing between the terminals and the rear wall is prevented.

2. The communication socket as claimed in claim 1, wherein the enclosure has a slot adapted to receive therein the rear wall of the casing.

* * * * *